United States Patent [19]

Niemeyer

[11] 3,987,388

[45] Oct. 19, 1976

[54] CURRENT LIMITING DEVICE

[75] Inventor: Lutz Niemeyer, Staretschwil, Switzerland

[73] Assignee: BBC Brown Boveri & Company Limited, Baden, Switzerland

[22] Filed: July 8, 1975

[21] Appl. No.: 594,008

[30] Foreign Application Priority Data

Aug. 29, 1974 Switzerland ..... 11759/74

[52] U.S. Cl. ..... 337/114; 337/122; 337/159

[51] Int. Cl.[2] ..... H01H 87/00

[58] Field of Search ..... 337/114, 115, 116, 117, 337/159, 118, 119, 122

[56] References Cited

UNITED STATES PATENTS

| | | | |
|---|---|---|---|
| 3,599,137 | 8/1971 | Ito | 337/159 X |
| 3,611,041 | 10/1971 | Itoh | 337/114 X |
| 3,886,511 | 5/1975 | Miyamoto et al. | 337/119 |

*Primary Examiner*—George Harris
*Attorney, Agent, or Firm*—Pierce, Scheffler & Parker

[57] ABSTRACT

A current limiting device includes a duct containing a current-limiting material therein which serves to interconnect two spaced terminals but which is evaporable when subjected to an over-current flowing through the material between the terminals. The wall forming this duct includes a region made from a highly-temperature-resistant material which has a relatively small cross-section that connects with another region of the duct having a larger cross-section, and the wall part forming the region of smaller cross-section is surrounded by a resistor member connected electrically in parallel with the current-limiting material disposed therein and which has a resistance value such that the current-limiting material is relieved of current following onset of an over-current condition.

11 Claims, 3 Drawing Figures

CURRENT LIMITING DEVICE

The present invention relates to an electric current limiting device in which a duct containing evaporable current limiting material is connected between the outer terminals, the duct having a region of smaller cross-section.

German patent application DT-AS 2,028,593 discloses a current limiting device in which an insulation member provided with a duct-forming longitudinal bore is disposed between the terminal electrodes, and wherein the longitudinal bore has an end zone of reduced cross-section. The longitudinal bore contains current limiting material, for example of the group of metals such as sodium and potassium and its alloys, which serves to electrically connect the terminal electrodes to each other at normal operating currents but is evaporable if an overcurrent occurs which is above a specific threshold value. As soon as the threshold value is exceeded, the current limiting material is first evaporated in the region of reduced cross-section (operating response) whereupon evaporation progresses in the direction of the remaining part of the duct. An arc, which causes burning of the duct wall, is struck in the evaporated material. Burning in the narrow part of the duct however is detrimental in view of maintaining a response characteristic which is as uniform as possible, but burning in the remaining part of the duct, more particularly the part of larger cross-section, is desirable because evaporated duct wall material increases the cooling of the arc and therefore its burning voltage.

It is the object of the present invention to reduce wall burning in the smaller cross-section part of the duct which triggers the current limiting operation and thus to achieve reproducible performance and a prolonged service life for the current limiting device.

According to the invention this objective is achieved in that the duct wall consists of highly temperature-resistant material, at least in the region of the reduced cross-section, and that the duct wall is surrounded by a resistor member, constructed as an electrical shunt, the resistance value of which is such that the above-mentioned region of the current limiting material is relieved of current loading after the device comes into operation.

Figure 1:
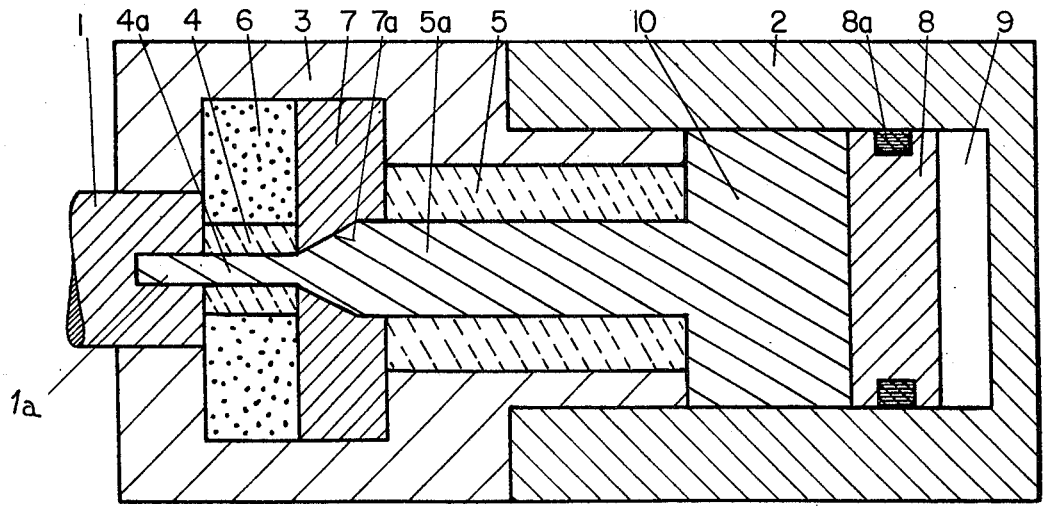
Figure 2:
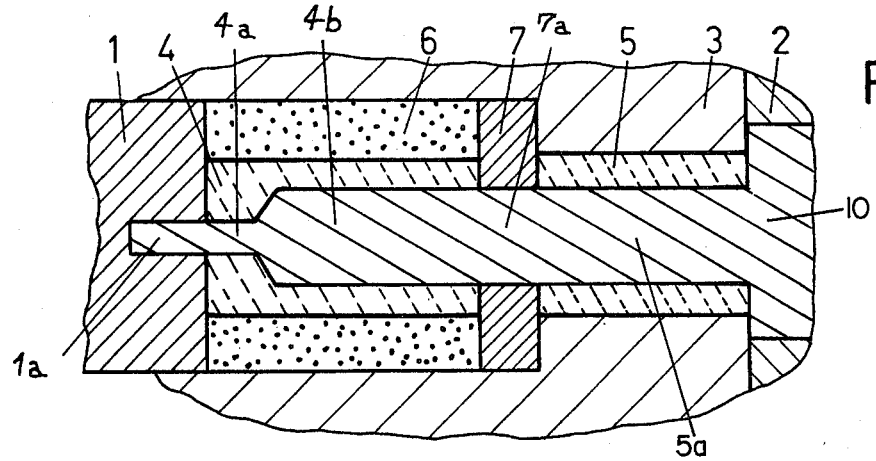
Figure 3:
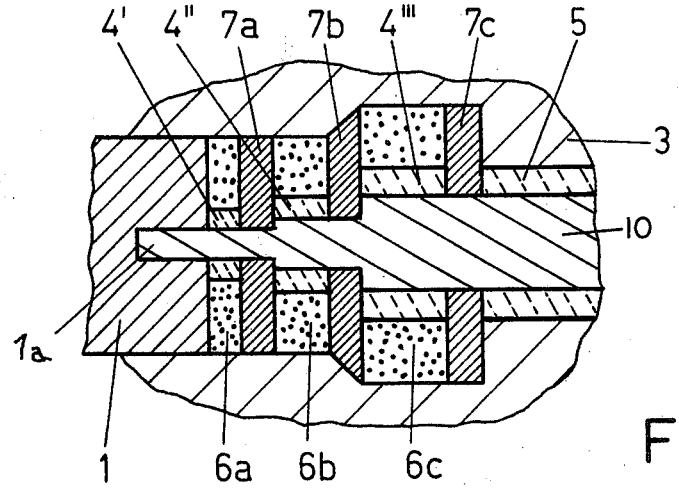

Embodiments of the invention are shown in the accompanying drawing, in which;

FIG. 1 illustrates one complete embodiment of the improved current-limiting device in longitudinal central section, FIG. 2 is also a longitudinal central section illustrating a modified embodiment of the improved duct structure and surrounding resistor member, and FIG. 3 is also a longitudinal central section illustrating a further embodiment of the improved duct structure and surrounding resistor member and wherein the transition from the smaller to the larger cross-sectional portion of the duct is made is steps.

With reference now to the drawings and to FIG. 1 in particular, it will be seen that the two spaced-apart terminal members 1 and 2 which have a cylindrical configuration are supported by an insulator member 3 therebetween in a pressure-tight manner. Terminal member 1 is solid throughout except for a central blind bore 1*a* in one end and is entered into an opening of corresponding diameter in one end of the insulator member 3. The other terminal member 2 is formed as a cylinder and one end thereof is fitted upon a section of reduced cross-section at the other end of insulator member 3.

Supported centrally within insulator member 2 is a tubular member 4 made from a highly-temperature-resistant material, for example, ceramic aluminum oxide, which contains a longitudinal through-bore 4*a* of relatively small cross-section. The tubular member 4 lies in contact with the end face of terminal member 1 and the blind bore 1*a* in the latter coincides with the bore 4*a*. An annular resistor member 6 of the same axial length as the tubular member 4 surrounds the latter and its inner periphery lies in contact with the periphery of the tubular member 4, thus forming an electrical shunt for current limiting material disposed in the bore 4*a* since one end face of the resistor member 6 also lies in contact with the end face of terminal member 1, and the opposite face of resistor 6 lies in contact with one end face of an annular electrode member 7 which also engages the corresponding end face of member 4. As seen in FIG. 1, the electrode member 7 includes a central bore 7*a* forming a continuation of the bore 4*a* and which has a conical configuration effecting a progressive enlargement of the bore in the direction from left to right.

Another tubular member 5 located within the insulator 3 has one end face in contact with the other end face of electrode member 7 and includes a central bore 5*a* the diameter of which is equal to the maximum diameter of bore 7*a*. Tubular member 5 is constructed from a material designed to evaporate up to a specific degree under the influence of the electric arc which is created under an excess current-flow condition through the device. A suitable material for the member 5 is ceramic beryllium oxide.

Located within the cylinder part of the terminal member 2 is a piston 8 provided with a sealing ring 8*a*. The chamber 9 formed within the cylinder between piston 8 and the end wall of the terminal member 2 is filled with a compressed gas which provides for pressure equalization. Evaporable current-limiting material 10 e.g. a material such as that previously mentioned fills all of the bores, e.g. bores 1*a*, 4*a*, 7*a*, 5*a* and the cylindrical space in terminal member 2 up to piston 8 to establish a current-conducting path from terminal member 1 to terminal member 2. During vaporization of the material 10, an internal pressure will be developed with the result that piston 8 will be moved slightly to the right against the counterpressure of the gas within chamber 9 in order to prevent the pressure within the space occupied by the material 10 from becoming excessive.

The improved current-limiting device operates in the following manner.

If a current of short-circuit magnitude arises, the current-limiting material evaporates initially in the bore 4*a* having the smallest cross-section of the entire length of the bore which consists of the three end-to-end connected sections 4*a*, 7*a* and 5*a*. The resultant arc then begins to propagate in the direction from left to right towards the bore part 5*a*. After triggering, the bore part 4*a* is relieved of its current load by resistor 6 connected electrically in parallel therewith and whose resistance has, in the meantime been sufficiently reduced so that burning on the wall of the bore 4*a* is substantially reduced. This results in the desired lengthening of the service life of the current-limiting device.

In order to achieve the desired relief of current loading for the smallest part 4*a* of the entire bore length, resistor 6 is constructed from a material having a negative temperature coefficient, for example, ceramic vanadium oxide. However this current shunting resistor can also be so constructed that it reacts to the burning voltage of the electrical arc struck within the bore 4*a*, i.e. by being constructed from a voltage-dependent resistive material, for example, silicon carbide.

In the embodiment of FIG. 1, the bore 4*a* in member 4 is of uniform cross-section throughout the length of the member. However, in some cases, it may be advantageous for the axial length of the highly-temperature-resistant wall part of the tubular member 4 to be longer than the bore portion 4*a* having the smallest diameter. Such a modified construction is illustrated in FIG. 2 from which it will be noted that the tubular member 4 has a much longer length than in FIG. 1 and that the bore part 4*a* of the smallest cross-section merges into the remaining bore portion 4*b* whose cross-section is the same as that of the bore 7*a* through electrode member 7.

Finally, the transistion from small to larger cross-section portions of the entire length of the longitudinally extending bore can be made in several stages, such as by bore diameter stepping. Such a construction is shown in FIG. 3 from which it will be seen that the tubular member corresponding to member 4 in FIGS. 1 and 2 is constituted by three sections 4', 4'' and 4''', the bores in which are progressively increased in diameter. These sections are electrically shunted by the surrounding resistor members 6*a*, 6*b* and 6*c* whose resistance values can be graded where appropriate, and electrode members 7*a*, 7*b* and 7*c* are interposed between the several sections. Grading of the resistors 6*a* and 6*c* with respect to their resistance values can be achieved by adopting suitable dimensions and/or by adopting suitable and different resistive materials, in such manner that the resistance value diminishes in the direction of the tubular member 5.

I claim

1. In an electric current limiting device including a duct containing a current-limiting material therein which serves to electrically interconnect two spaced terminals but which is evaporable when subjected to an over-current flowing between the terminals, the improvement wherein the wall forming said duct includes a region made from a highly-temperature-resistant material and which has a relatively small cross-section that connects with another region of the duct having a larger cross-section, and wherein the wall forming said duct region of relatively small cross-section is surrounded by a resistor member which is connected electrically in parallel with the current-limiting material disposed therein, the resistance value of said resistor being such that the current-limiting material is relieved of current following onset of an over-current condition.

2. A current-limiting device as defined in claim 1 wherein said resistor member is constructed from a material having a negative temperature coefficient.

3. A current-limiting device as defined in claim 2 wherein said resistor member is constructed from ceramic vanadium oxide.

4. A current-limiting device as defined in claim 1 wherein said resistor member is constructed from a material having a voltage-dependent material.

5. A current limiting device as defined in claim 4 wherein said resistor member is constructed from silicon carbide.

6. A current limiting device as defined in claim 1 wherein said resistor member is contiguous to an electrode member provided with a through-bore which forms a part of the duct wall.

7. A current-limiting device as defined in claim 1 wherein said resistor member has an axial length which is longer than the duct region having said relatively small cross-section.

8. A current-limiting device as defined in claim 1 wherein said duct region having said relatively small cross section is constructed in stepped form, and each step of the region is provided with a surrounding electrically paralleling resistor.

9. A current-limiting device as defined in claim 1 wherein the wall forming the duct region of relatively small cross-section is constructed from ceramic aluminum oxide.

10. A current-limiting device as defined in claim 1 wherein the wall forming the region of said duct containing the current-limiting material and which has the larger cross-section is constructed from a material which evaporates up to a specific degree under the effect of an electrical arc produced within the duct upon evaporation of said current-limiting material.

11. A current-limiting device as defined in claim 10 wherein the wall forming the duct region of larger cross-section is constructed from ceramic beryllium oxide.

* * * * *